US007022955B2

(12) United States Patent
Watkins

(10) Patent No.: US 7,022,955 B2
(45) Date of Patent: Apr. 4, 2006

(54) APPARATUS AND METHODS OF MAKING A MICROWAVABLE CONTAINER FOR FOOD PRODUCTS

(76) Inventor: Jeffrey T. Watkins, 14551 268th Ave., NW., Zimmerman, MN (US) 55398

( * ) Notice: Subject to any disclaimer, the term of this patent is extended or adjusted under 35 U.S.C. 154(b) by 0 days.

(21) Appl. No.: 10/850,737

(22) Filed: May 21, 2004

(65) Prior Publication Data

US 2005/0006383 A1 Jan. 13, 2005

Related U.S. Application Data

(60) Continuation of application No. 10/301,045, filed on Nov. 21, 2002, and a continuation-in-part of application No. 09/944,285, filed on Aug. 30, 2001, now Pat. No. 6,586,715, which is a division of application No. 09/523,493, filed on Mar. 10, 2000, now Pat. No. 6,320,172.

(60) Provisional application No. 60/124,243, filed on Mar. 12, 1999, provisional application No. 60/332,019, filed on Nov. 21, 2001.

(51) Int. Cl.
*H05B 6/80* (2006.01)

(52) U.S. Cl. ..... 219/725; 219/727; 219/730

(58) Field of Classification Search ..... 219/725–732, 219/734, 759, 762; 426/107–123, 234, 243; 99/DIG. 14; 229/43, 125.34
See application file for complete search history.

(56) References Cited

U.S. PATENT DOCUMENTS

| | | | | |
|---|---|---|---|---|
| 3,066,844 | A | 12/1962 | Moore | |
| 4,015,085 | A | 3/1977 | Woods | |
| 4,036,423 | A * | 7/1977 | Gordon | 229/125.34 |
| 4,038,425 | A * | 7/1977 | Brandberg et al. | 219/727 |
| 4,210,674 | A | 7/1980 | Mitchell | |
| 4,268,738 | A | 5/1981 | Flautt, Jr. et al. | |
| 4,279,933 | A * | 7/1981 | Austin et al. | 229/125.34 |
| 4,448,309 | A * | 5/1984 | Roccaforte et al. | 426/107 |
| 4,553,010 | A | 11/1985 | Bohrer et al. | |
| 4,641,005 | A | 2/1987 | Seiferth | |
| 4,678,882 | A * | 7/1987 | Bohrer et al. | 219/730 |
| 4,734,288 | A * | 3/1988 | Engstrom et al. | 426/107 |
| 4,825,025 | A | 4/1989 | Seiferth | |
| 4,861,958 | A | 8/1989 | Bohrer et al. | |
| 5,008,024 | A | 4/1991 | Watkins | |
| 5,097,107 | A * | 3/1992 | Watkins et al. | 219/727 |
| 5,214,257 | A | 5/1993 | Riskey | |
| 5,334,820 | A | 8/1994 | Risch et al. | |
| 6,320,172 | B1 * | 11/2001 | Watkins | 219/725 |
| 6,586,715 | B1 * | 7/2003 | Watkins | 219/725 |

FOREIGN PATENT DOCUMENTS

EP 0317203 B1 5/1989

(Continued)

*Primary Examiner*—Tu Hoang
(74) *Attorney, Agent, or Firm*—Howrey LLP; David W. Clough

(57) ABSTRACT

The present invention relates to a container for the microwave heating of a food product in which a sheet of barrier material is sealed around a food product to a blank having one or more panels which can be folded to assemble a container. The sheet of barrier material forms a pocket inside which a food product may be disposed. The sheet of barrier material is sealed to one of the panels, so that a peripheral outer portion is formed to separate the food product from the remaining panel or panels. The barrier material may be moisture impervious, and may be sealed to the blank using a vacuum platen or heat-sealing methods. A microwave susceptor can be disposed on the blank, which is made from a material suitable for microwave heating such as a polymer and paperboard laminate.

29 Claims, 9 Drawing Sheets

FOREIGN PATENT DOCUMENTS

| | | | |
|---|---|---|---|
| EP | 0320294 | A2 | 6/1989 |
| EP | 0205304 | B1 | 3/1991 |
| EP | 0451530 | A2 | 10/1991 |
| FR | 1399 151 | A | 4/1965 |
| GB | 841015 | | 7/1960 |
| GB | 2046060 | A | 11/1980 |
| WO | WO 91/15096 | | 10/1991 |
| WO | WO 96/36546 | | 11/1996 |

* cited by examiner 852
851
810
802
808
806
805
807
804
809

842
810
802

828
842
812
810
802

830
813
816
812
842
815
820
802

844
846
816
848

913
844
816
816
846
846
848
848

APPARATUS AND METHODS OF MAKING A MICROWAVABLE CONTAINER FOR FOOD PRODUCTS

CROSS-REFERENCE TO RELATED APPLICATION

This application is a continuation of U.S. application Ser. No. 10/301,045, filed Nov. 21, 2002, which claims priority to U.S. Provisional Application No. 60/332,019, filed on Nov. 21, 2001, and is also a continuation-in-part of U.S. application Ser. No. 09/944,285, filed Aug. 30, 2001 now issued as U.S. Pat. No. 6,586,715, which is a divisional of U.S. application Ser. No. 09/523,493, filed Mar. 10, 2000 now issued as U.S. Pat. No. 6,320,172 which claims priority to U.S. Provisional Application No. 60/124,243, filed Mar. 12, 1999.

BACKGROUND OF THE INVENTION

1. Field of the Invention

The present invention relates generally to microwavable containers for food products and apparatus and methods of making the same, and, more particularly, to apparatus and methods for making a microwavable tub for storing, shipping, heating and serving food products.

2. Description of Related Art

The increasing popularity of microwave cooking has lead to the development of several types of containers for microwave heating of food products. For example, a number of bag-type containers for microwave popping of popcorn are available. These containers are typically formed of paper or other flexible materials, and often include heating elements of microwave interactive susceptor material that absorb microwave energy to generate heat, which pops the popcorn. Such containers are typically shipped and stored in a folded configuration and, upon heating and popping of the corn, unfold into an expanded configuration.

More rigid containers have also been developed, such as cup-shaped containers for microwave heating of popcorn. These containers typically are in the form of generally frustoconical paperboard tubs. A microwave susceptor is installed on or around the floor of the tub and a quantity of unpopped corn and cooking oil or shortening is placed in the tub's interior. A plastic film or other barrier material is often applied over the corn in an effort to seal out external contaminants, seal in moisture, and preserve freshness. Morever, it has been found that moisture loss from popcorn inhibits popping and reduces popped volume.

Efforts to form a hermetic seal around the food product in previously known containers have proven less than fully satisfactory. One known container provides a concave cooking tray formed of coated paperboard stock for containing the food product and heating through microwave absorption. The tray includes a number of folds or corrugations, which present discontinuities in any seal attempted to be formed with a barrier material. These discontinuities form air channels that allow moisture loss from the food product. In an attempt to overcome this problem, a moisture impervious liner has been provided around the exterior of the tray, which liner is sealed to the barrier film around the lip of the tray. The multiple components required in previously known containers, however, typically results in increased costs of materials and assembly. Another disadvantage found to inhere in previously known containers incorporating a tray for containing the food product is the potential for the food product to be displaced inadvertently from the tray onto the shelf or ledge formed by the lip of the tray, removing the food product from thermal contact with the microwave susceptor material, often resulting in incomplete cooking or popping.

Previously known paperboard tub containers for microwave cooking are typically assembled by depositing the food product onto the floor of an upright container, or into a heating tray placed within the container, and then installing liners and/or film in various configurations in an attempt to form a seal around the food product. As discussed above, the provision of cooking trays and liners undesirably increases expense and may adversely affect cooking performance. If the food product is distributed across the container floor, attempts to form a seal around the food product by sealing a cover film to the container walls typically are unsuccessful, as moisture may escape through the walls and floor of the container, and/or through the seam between the walls and floor.

Thus, there is a need for a container for microwave cooking of food products, which overcomes disadvantages of previously known containers. A need further exists for an economical and efficient method and apparatus of making such a microwavable container for food.

SUMMARY OF THE INVENTION

The present invention is related to a method and apparatus for assembling a container for microwave heating a food product therein. In one embodiment, the container includes a tub assembly having a moisture-impervious floor and one or more sidewalls. A quantity of food product, such as, for example, popcorn, is placed in a pocket formed in a sheet of barrier material, and a continuous heat seal is formed between a portion of an interior surface of the tub assembly and the sheet of barrier material. In one embodiment, the heat seal is formed between the floor of the tub assembly and the barrier material so that at least a partial peripheral outer portion is formed to separate the food product from the wall panel(s) of the tub. A microwave susceptor can be disposed to the floor for heating the food product.

The method of making a container for microwave heating of a food product comprises forming a pocket in a film; depositing a quantity of a food product within the pocket; positioning a tub assembly over the pocket in an upside-down orientation so that the floor of the tub assembly overlies and covers the pocket; and forming a seal between the film and a portion of the interior surface of the tub assembly at least partially about the pocket to encapsulate the quantity of food product. In one embodiment, the seal is formed between the film and the floor of the tub assembly at least partially around the pocket such that at least a partial peripheral outer portion is formed to separate the food product from the at least one wall panel of the tub assembly. Additionally, the method may comprise providing a mandrel having a top portion with a recess defined therein and draping the film over the mandrel to form the pocket within the defined recess of the mandrel. The method of the present invention, in contrast to the prior art where food product was put into a container, places the tub assembly in an inverted orientation over the food product for better sealing.

In one embodiment, the apparatus of the present invention provides an apparatus that has a container integration subassembly that communicates with a film supply such as a film roll, a supply of food product, and a supply of pre-erected tub assemblies. In an alternative embodiment, the apparatus includes a tub assembly fabrication subassembly for production of the pre-erected tub assemblies. In this embodiment, each subassembly interacts with and communicates to each other. These subassemblies can be physically separated from each other or integrated together. Thus, in one example, the container integration subassembly is in communication with the tub assembly fabrication subassembly.

The tub assembly fabrication subassembly forms a tub assembly with a floor, a mouth, an interior surface and at least one sidewall panel from a blank. The container integration subassembly forms a pocket in a sheet of film, deposits a quantity of a food product within the pocket, receives the tub assembly over the pocket in an upside-down orientation with its mouth moving downwardly to the pocket, and forms a seal between the sheet of film and the interior surface of the tub assembly.

The tub assembly fabrication subassembly has a means for folding a wall panel blank about fold lines to position a first edge surface and a second edge surface in at least partial overlapping registration; a means for connecting at least a portion of the first edge surface to at least a portion of the second edge surface to form a blank structure; a means for erecting the blank structure to form a sidewall structure having a plurality of sidewalls; a means for forming, from bottom panel a bottom structure having edge panels oriented substantially perpendicular to a base of the bottom structure; and a means for connecting a least a portion of the edge panels of the bottom structure to a portion of the sidewalls of the sidewall structure adjacent a bottom edge of the sidewall structure.

The container integration subassembly has a means for conveying a plurality of a plurality of mandrels along a generally linear transfer path. Each mandrel has a recess sized for forming a desired pocket in a film. The container integration subassembly has a food product station having a means for depositing a predetermined quantity of a food product within the pocket; a container erection station having a means for positioning a pre-fabricated tub assembly over the pocket in an upside-down and overlying orientation, and a means for forming a seal around the pocket between the interior surface of the tub assembly and the barrier material to form a food product container.

BRIEF DESCRIPTION OF THE DRAWINGS

The accompanying drawings, which are incorporated in and constitute a part of the specification, illustrate several embodiments of the invention and together with the description, serve to explain the principals of the invention.

FIGS. 8(A–E) show schematically a method of assembly of a container according to another embodiment of the present invention;

DETAILED DESCRIPTION OF THE INVENTION

Figure 1:
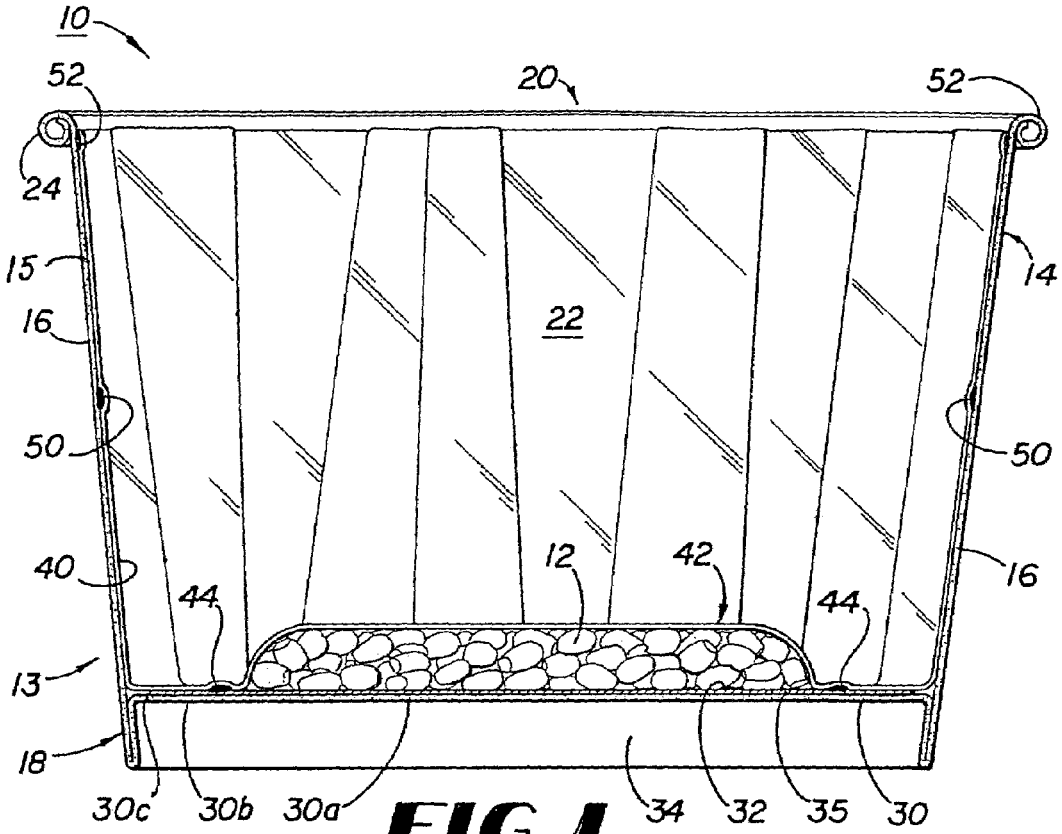
FIG. 1 shows a cross-sectional elevation of a container according to one embodiment of the present invention.

The present invention is more particularly described in the following examples that are intended to be illustrative only since numerous modifications and variations therein will be apparent to those skilled in the art. As used in the specification and in the claims, the singular form "a," "an" and "the" include plural referents unless the context clearly dictates otherwise. Also, the meaning of "in" includes "in" and "on" unless the context clearly dictates otherwise. Referring to the drawing, like numbers indicate like parts throughout the figures.

Referring to FIGS. 1–5, the present invention is related to a container 10 for microwave heating, as with a standard microwave oven, of a food product 12. The food product 12 may be, for example, popcorn, pork rinds, puffed cheese snacks, or other food product. The container of the present invention is particularly well-suited for, but is not limited to, the heating of food products that expand or puff when cooked. In alternative embodiments, the container of the present invention can be used to heat beverages, such as coffee or tea. Cooking oil, shortening, spices, preservatives, flavorings, stabilizers, colorants, or other substances may be included with the food product 12. Moreover, one or more surfaces of the container 10 can be printed, labeled or otherwise provided with text, graphics or other features for marketing, informational or source indicating purposes.

In another aspect, referring now to FIGS. 6–11, the present invention is related to a method of assembling a container for microwave heating a food product therein substantially similar to the container 10. Among other things, in contrast to the prior art where food product was put into a container, the method of the present invention places the container over the food product for a better sealing as discussed in detail below.

Figure 7:
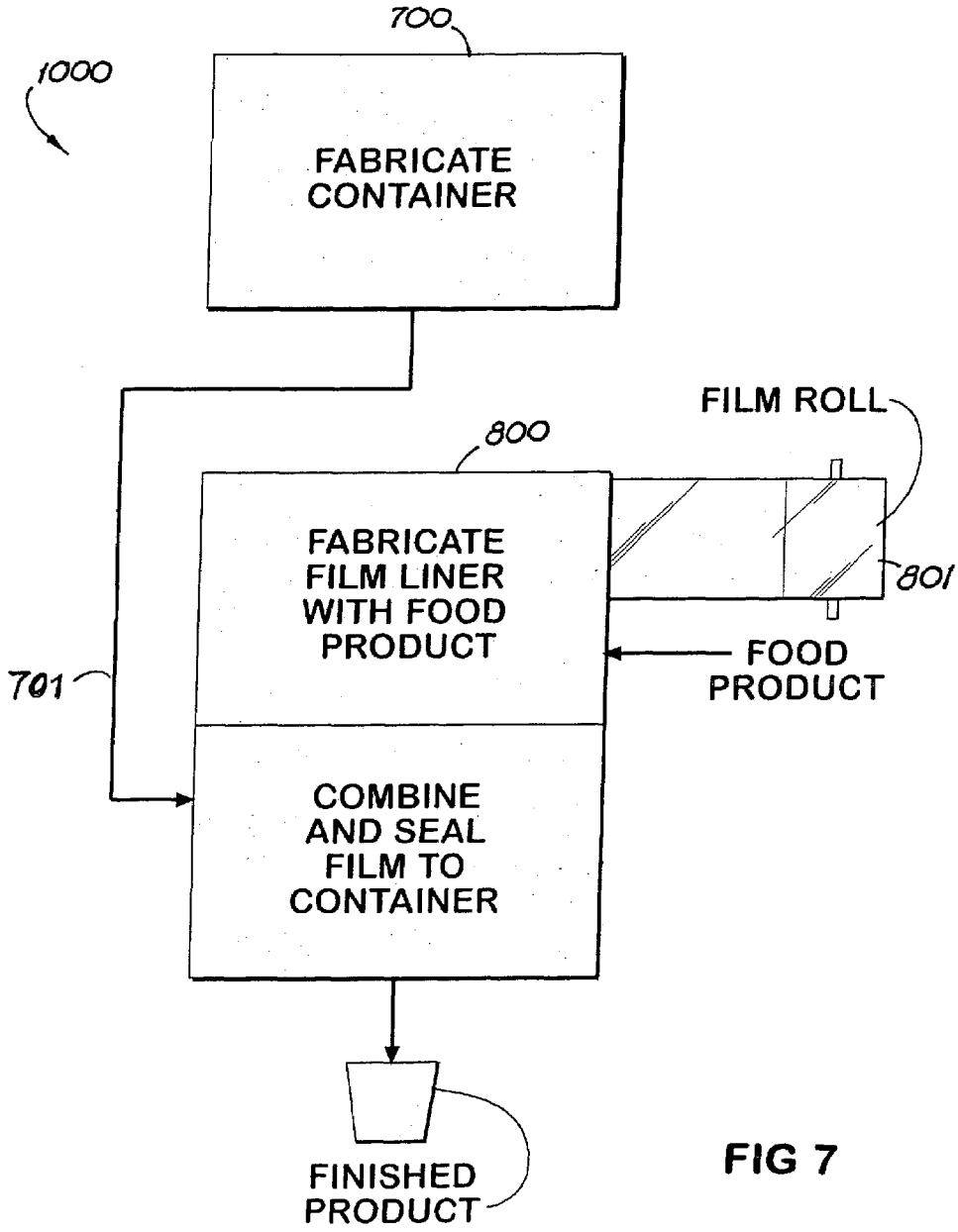
FIG. 7 shows a block diagram of the apparatus for making a container for microwave heating of a food product according to one embodiment of the present invention.

In a further aspect, with reference to FIGS. 7–11, the present invention is related to an apparatus of assembling a container 910 for microwave heating a food product therein substantially similar to the container 10. Among other things, as shown in FIG. 7, the present invention provides an machine 1000 that has a container integration subassembly 800, which is in communication with a film supply such as a film roll 801, a supply of a food product, and a supply of pre-erected tub assemblies 701. In an alternative embodiment, the machine may have two subassemblies: a container integration subassembly 800 and a tub assembly fabrication subassembly 700 for fabricating the prefabricated tub assemblies. Each subassembly may interact with and communicate to each other. As one will appreciate, the subassemblies can be physically separated from each other or integrated together.

As shown FIGS. 1–5, and as disclosed in U.S, Pat. No. 6,320,172 to Watkins, which is incorporated herein in its entirety, the container 10 includes a tub assembly 13 having a substantially upright sidewall assembly 14, formed of paperboard, paper, cardboard, plastic, or other foldable, moldable or deformable material. Acceptable results may be obtained, for example, using 15, 18 or 24 point SBS (solid bleached sulfate) paperboard. The material(s) of construction used to form the sidewall assembly 14 are selected to result in a container 10 that is substantially rigid (i.e., capable of supporting the weight of the container 10 and its contents in normal use by a consumer without undue deflection), and to provide economy and ease of fabrication. One or both of the interior and exterior faces of the sidewall assembly can comprise a coating, laminate, coextrusion or other treatment, such as for example polyethylene or other polymer(s), fluorocarbon treatment or wax, to provide a barrier against staining or absorption of oils, water or other liquids from the food product 12. As a representative example, a fluorocarbon treatment sold under the tradename FC807 by the 3M Company can be applied to the sidewall assembly.

The sidewall assembly 14 includes at least one wall panel 16. A single, curved wall panel 16 can be formed into a generally cylindrical or frustoconical container 10, or multiple flat wall panels can be formed into a multi-walled, polygonal container 10 as will be described more particularly with reference to FIGS. 2–5. For example, in the embodiment shown in FIG. 2 and described in more detail below, the sidewall assembly 14 includes wall panels 16*a*–16*d*. The sidewall assembly 14 preferably further includes a base portion 18 at the lower edge of the wall panel(s) 16, which is adapted to rest on a support surface such as the floor of a microwave oven (not shown), and maintain the container 10 in a stable, upright position. The upper extent of the sidewall assembly 14 preferably comprises an open mouth 20 providing access to the interior volume 22 bounded by the sidewall assembly 14. The upper edge(s) of the wall panel(s) 16 may be rolled, folded, or otherwise formed to provide a lip 24, to enhance the structural integrity of the container 10, and/or to assist in handling the container 10.

Figure 2:
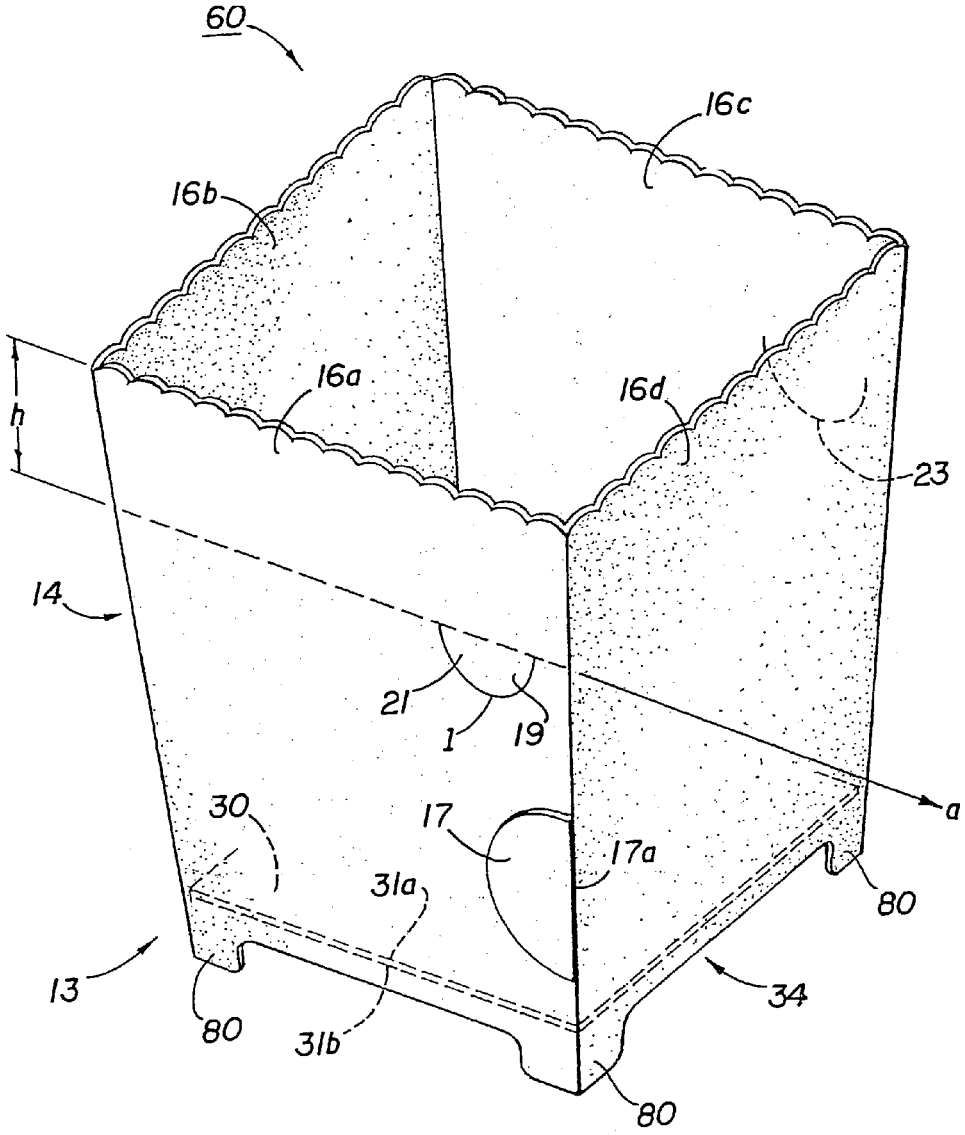
FIG. 2 shows a perspective view of a container according to yet another embodiment of the present invention.
Figures 3A, 3B, 4:
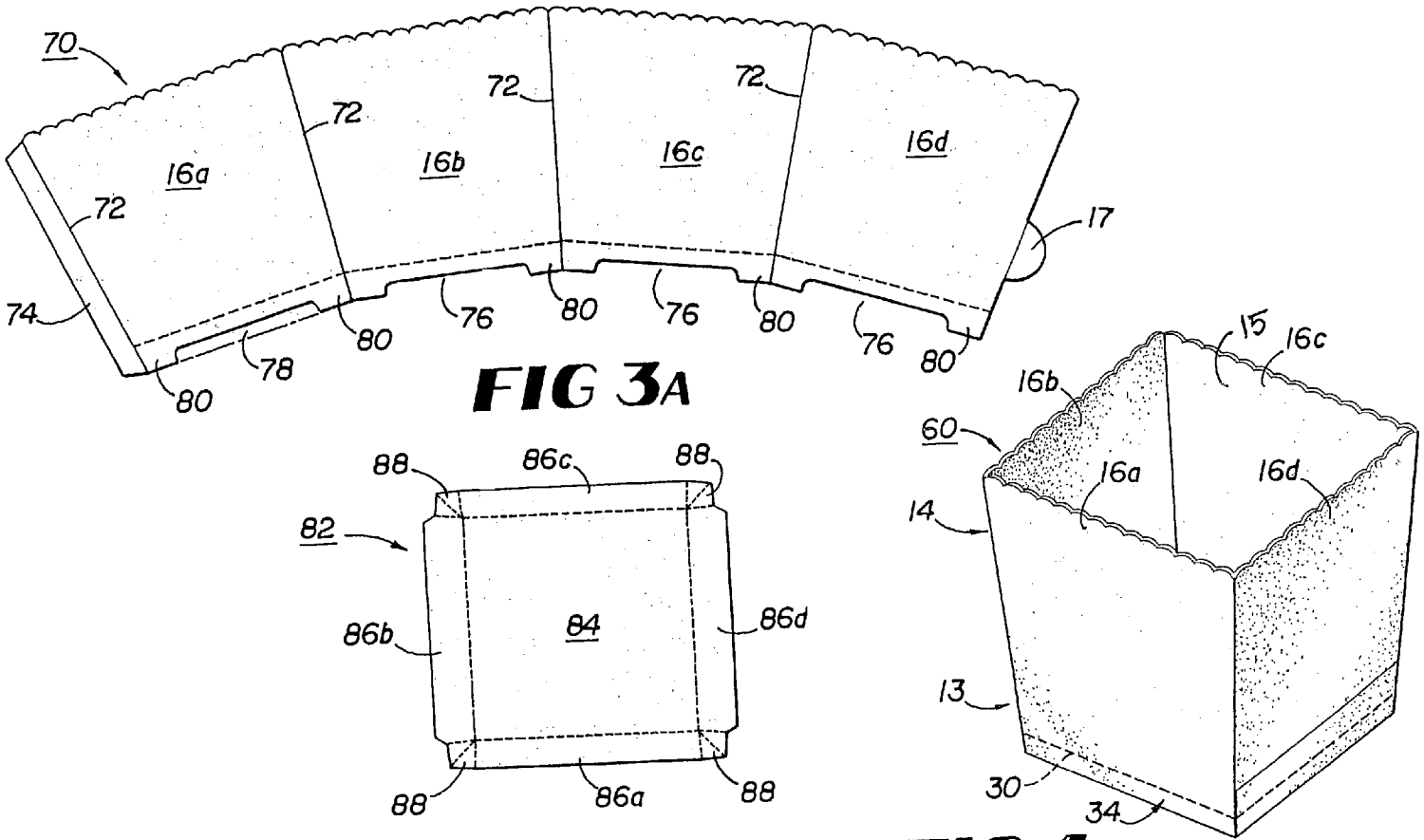
FIGS. 3*a* and 3*b* show top plan views of blanks used to fabricate the container of FIG. 2, according to one form of the invention.
FIG. 4 shows a perspective view of a container according to yet another embodiment of the present invention.

One or more handles, projections or other surface features may be provided to assist in handling the container 10. For example, at least one optional handle 17, as best shown in FIG. 2, is especially helpful after the heating of food products and the container 10 may be hot. Optional handle 17 is a tap or flap extending away from the wall panel 16*d* and can be folded along an upwardly extending axis that is substantially non-horizontal, such as edge 17*a*, so as to position the handle 17 against an adjacent wall panel, such as wall panel 16*a* in the embodiment shown in FIG. 2. This foldable characteristic of handle 17 allows handle 17 to move between an inoperative position where handle 17 is co-planar with the wall panel 16*a* and an operative position where handle 17 extends away from the wall panel 16*a* and therefore not to significantly affect the stacking of one container 10 into another one. In one embodiment, handle 17 is an integral part of the wall panel 16*d* in one embodiment as shown in FIG. 3*a*. Alternatively, handle 17 can be a separate element and attached or fixed to the wall panel 16*d* at a location of the user's choice. For instance, handle 17 can be a separate piece of paperboard, paper, cardboard, plastic, or other foldable, moldable or deformable material having a sticky end that can be stuck to the wall panel 16 prior to use by the consumer. In this manner, the stackability of the container 10 is preserved. Note that although the handle 17 is associated with the wall panel 16*d* in the embodiments shown in FIGS. 2 and 3*a*, handle 17 may be associated with any of the wall panels 16*a*–16*d*. Additionally, the substantially upright or vertical axis about which handle 17 pivots can be located on any of the wall panels 16*a*–16*d* at any desired location thereon. Also, more than one handle can be utilized to further facilitate handling of the container 10.

Additionally, at least one projection 19 can be formed to facilitate stacking two or more containers 10 together. For the embodiment shown in FIG. 2, projection 19 is formed by cutting the wall panel 16*a* along the solid line l and then pushing flap portion 21 outwardly away from the wall panel 16*a* so that the flap portion 21 pivots upwardly along axis a to assume its operative position. In the inoperative position of projection 19, the projection 19 is co-planar with the wall panel 16*a* and the bottom of the projection 19 merges with the wall panel 16*a* seamlessly and, in the embodiment shown in FIG. 2, the projection 19 is part of the wall panel 16*a*. The formed projection 19 can be considered as a "stacking ear" projecting from the wall panel 16*a* and movable along the substantially horizontal axis a. The projection 19 is located at a distance h from the upper edge of the wall panel 16*a*. The distance h is variable to accommodate variable uses of the container 10. The container 10 can have more than one stacking ear, as for instance in the embodiment shown in FIG. 2, and more clearly shown in FIG. 2*a*, wherein the container 10 also has a projection 23 or stacking ear formed on the wall panel 16*c*, opposite the projection 19 with projection 23 being similarly dimensioned to projection 19. Although it is not necessary, it may be desirable that if container 10 has two or more projections, they are formed on opposing wall panels. The projections may also be similarly shaped, each extending the distance h from the upper edge of the wall panel 16*a* and pivoting about a respective axis a. By providing the wall panel(s) 16 with a slight outward slope from the base 18 to the mouth 20, two or more containers 10 as described herein may be nestably stacked, one within another. If the container 10 is of a type having at least one projection 19, the combination of the outward slope of the wall panel(s) 16 and the projection(s) 19 in the operative position facilitates the stacking of multiple containers in a nested array. The nested array of containers 10 can be packaged as a unit, as by applying a shrink-wrapped sleeve or other overwrap.

Figure 2A:
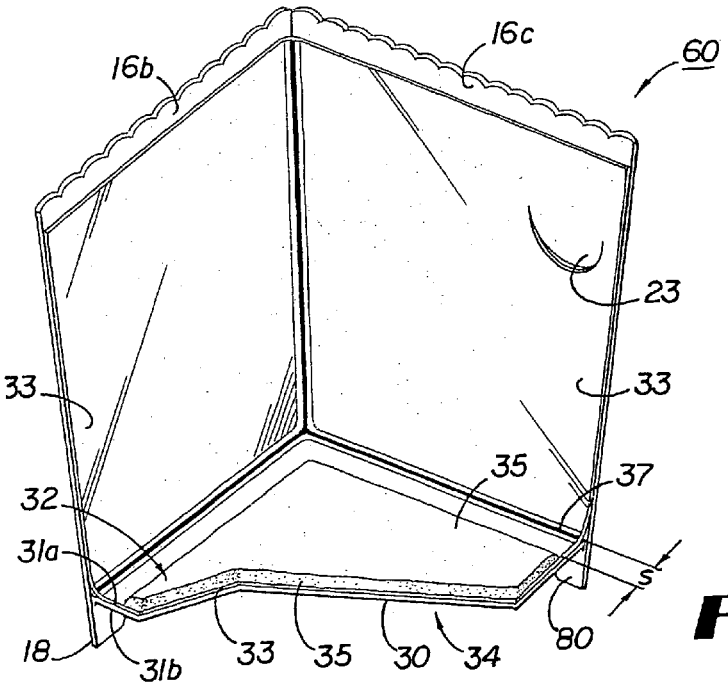
FIG. 2*a* shows a partially cut-away, exploded view of the container of the present invention shown in FIG. 2.

Referring to FIG. 2*a*, the tub assembly 13 further includes an interior surface 15, and a floor portion 30 extending generally horizontally from the wall panel(s) 16. The floor portion 30 has an interior face 31*a* defining the lower boundary of the interior volume 22 of the container 10, and an exterior face 31*b* opposite the interior face 31*a*. The floor 30 comprises a moisture-impervious material to prevent moisture loss from food product 12 encapsulated thereby, as will be described below. The floor 30 may be formed from a moisture barrier material or is provided with a moisture barrier coating or layer along substantially its entire interior face. Acceptable results have been obtained, for example, using 20 or 24 point SBS paperboard with a 2 mil polyester laminated on its interior face. Alternatively, acceptable results can be obtained by using 12.5–13 point SBS paperboard laminated on its interior face with 8 lb./ream nylon. Other polymer coatings, laminates, coextrusions or layerings, such as for example: polypropylene; polyvinyl dichloride (PVDC)-coated nylon; PVDC-coated polyester; and/or polyester and polypropylene composites, may be used to provide substrate materials such as paperboard, cardboard, paper or plastics with acceptable barrier properties.

Figure 2B:
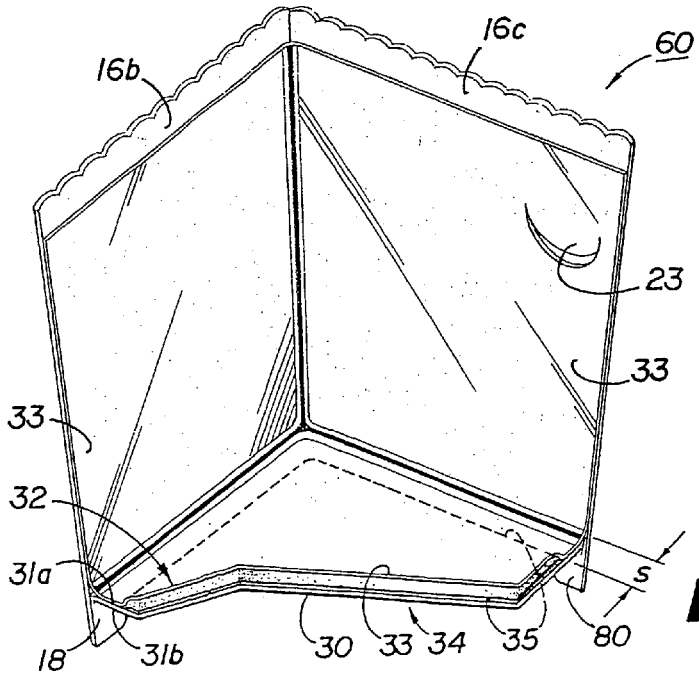
FIG. 2*b* partially shows a partially cut-away, exploded view of the container according to one embodiment of the present invention shown in FIG. 1.

The floor 30 can be integrally formed with the wall panel(s) 16, or can be a separate component attached to the wall panel(s) by adhesive, folding, crimping, or other standard attachment means. A microwave susceptor 32, such as a 48-gauge or 2 mil metallized polyester film, vacuum deposited metal, carbon or metallic based coatings, laminates, inks or print, other microwave interactive material(s), or any combination of them, is preferably disposed to the floor 30. The susceptor 32 can be laminated or otherwise affixed to the interior face 31*a* of the floor 30. Alternatively, the susceptor 32 can be laminated or otherwise affixed to the exterior face 31*b* or be integral with the floor 30. The susceptor 32 is sized and placed to be underlying at least the portion of the floor 30 upon which food product 12 is initially placed. FIGS. 2*a* and 2*b* show two embodiments of the susceptor 32 of the present invention.

The susceptor 32 includes a film of polyester 33 and a layer of metal 35. A metallic material such as aluminum is deposited onto the polyester film 33 to form a very thin metal layer 35 over the polyester film 33. The deposition process is controlled so that the metal layer 35 substantially occupies, but not necessary fully, the portions of floor 30 underneath the food product 12, as shown in FIG. 2*a*. Alternatively, the deposition process can be controlled so that the metal layer 35 fully occupies the portions of floor 30 underneath the food product 12. Then, portions of the metal layer are removed in areas where the metal layer is not needed. In other words, the distance s between the edge of the metal layer 35 and the line 37 representing the location of the bottom of a wall panel has a nonzero value in the preferred embodiment. The distance s can have a zero value as well. The susceptor 32 is disposed to the floor 30 such that the polyester film 33 is in contact with the floor 30 and indeed, covers substantially the entire floor 30, with the metal layer 35 to be in contact with the food product. The polyester film 33 covers the whole interior surface 31*a* and extends upwardly along the inner surfaces of the panel 16*a*–16*d* as shown in FIG. 2*a*. The food product is placed over the metal layer 35 and during cooking remains at all times in thermal contact with the susceptor 32. In another embodiment, the susceptor 32 has an additional film of polyester or similar material (not shown) covering the metal layer 35 so that the metal layer 35 is sandwiched in the lamination. In this embodiment, the food product 12 is not in direct contact with the metal layer 35. In a further embodiment as shown in FIGS. 1 and 2*b*, for examples, the susceptor 32 is disposed to the floor 30 such that the metal layer 35 is in contact with the floor 30, with the polyester film 33 to be in contact with the food product 12. Adhesive materials can be applied to the floor 30 prior to the application of the susceptor 32 to bind the metal layer 35 with the floor 30. Although acceptable microwave heating of the food product 12 can be obtained without the inclusion of the microwave susceptor 32, the inclusion of a microwave susceptor has been found to provide faster and more consistent heating.

The floor 30 can be raised a distance above the base 18, forming a lower chamber 34 between the exterior face 31*b* and the support surface such as the floor of a microwave oven. The lower chamber 34 is open to heat and air transfer to and from the container's surroundings, through the provision of one or more notches or openings, as is described in greater detail below. It is believed that placement of the exterior face 31*b* of the floor 30 of the container 10 approximately around 1.905 cm or smaller, but in no case greater than 3 cm, above the floor of a microwave oven or a similar supporting surface optimizes cooking performance, as this distance may place the microwave susceptor 32 applied to the interior face 31*a* of the floor 30 approximately one-quarter wavelength of the microwave energy above the oven floor.

Figure 6:
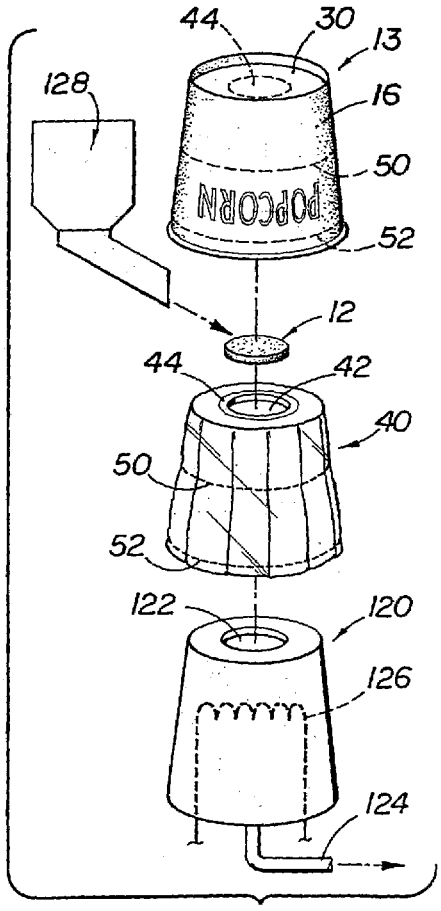
FIG. 6 depicts schematically a method of assembly of a container according to one form of the present invention.

Referring to FIGS. 1 and 6, the container 10 of the present invention further comprises a sheet of barrier material 40 forming a pocket 42 for containing a quantity of the food product 12. The sheet of barrier material 40 can go up along the wall 16 anywhere between the bottom of the wall 16 and the top of the wall 16. Indeed, in one embodiment as shown in FIG. 1, the sheet of barrier material 40 goes up to near the top of the wall 16. In another embodiment (not shown), the sheet of barrier material 40 just covers the floor 30 and does not go up the wall 16 at all. The pocket 42 is generally centered on the floor 30, and does not normally extend to the exterior edges of the floor 30 where it joins with the bottom of wall panel 16. In the embodiments where a microwave susceptor 32 with a sized metal layer 35 is provided, the pocket 42 substantially covers the sized metal layer 35 as shown in FIG. 1. In this manner, the floor 30 comprises a generally central portion 30*a* underlying the pocket 42 containing the food product, and an annular or peripheral outer portion 30*b* not having food product supported thereon. In one embodiment, the interior face 30*c* of this annular or peripheral outer portion 30*b* provides a sealing surface for contacting and forming a seal with the barrier material 40.

For a variety of food product applications, the barrier material 40 comprises a moisture-impervious (i.e., resistant to passage of water or water vapor) material such as, for example: a 50-gauge coated heat-sealable polyester film; a barrier-coated nylon film; or other heat-resistant and moisture impervious sheet polymers. A seal 44 is provided between the sheet of barrier material 40 and the moisture-impervious floor 30 around the pocket 42, to hermetically seal the food product 12 within the pocket 42. The seal 44 can be continuous or at least partially around the pocket 42 such that at least a partial peripheral outer portion is formed to separate the food product from the wall 16. In this manner, moisture loss from the food product is minimized or eliminated. Alternatively, the seal 44 can be continuous or at least partially around the pocket 42 between the barrier material 40 and the interior surface 15 of the tub assembly. The seal 44 may be formed by heat sealing. Alternatively, adhesives or other sealants can be used to form seal 44. Moreover, the seal 44 surrounding the pocket 42 of food product is preferably heat-releasable, such that the sheet of barrier material 40 will separate from the floor 30 upon heating to rise with expansion of the food product. One or more openings (not shown) can be provided through the sheet of barrier material 40, outside of the pocket 42 beyond the seal 44, to form release vents for allowing steam and expanding air to escape during heating.

Depending on the particular food product to be contained, the barrier material 40 may be impervious to air or other substances in addition to or instead of being moisture-impervious. For example, for containment of pork rinds, which are more susceptible to spoilage from exposure to oxygen than from moisture, the barrier material 40 may comprise an oxygen-impervious material. In alternative embodiments, the sheet of barrier material 40 may comprise a fluid permeable material that forms a barrier to external contamination, and/or that prevents release of materials contained in the pocket 42. For example, a container for preparing and heating coffee or tea may comprise a barrier material 40 of paper filter material forming a pocket containing ground coffee beans or tea leaves.

Containment of the food product 12 within the pocket 42 in the manner of the present invention provides a number of advantages over containers wherein the food product is distributed over the entire floor or disposed within a tray. For example, the floor 30 forms a flat sealing surface, and does not present discontinuities-forming air channels to allow moisture loss from the food product, as may occur with the use of a cooking tray. Because the pocket 42 does not extend to the edges of the floor 30, moisture cannot escape from the food product 12 through the joint between the floor 30 and the wall panel(s) 16, as may occur with containers wherein the food product is distributed over the entire floor. Also, if a food product such as popcorn is packaged with cooking oil or shortening, the food product can be substantially encapsulated within the oil or shortening within the pocket 42, thereby providing an additional barrier against moisture loss from the food product, and increasing the product's shelf life. The present invention also advantageously optimizes material usage and minimizes the number of components necessary to construct the container, thereby providing a more efficient and economical container.

Figure 1A:
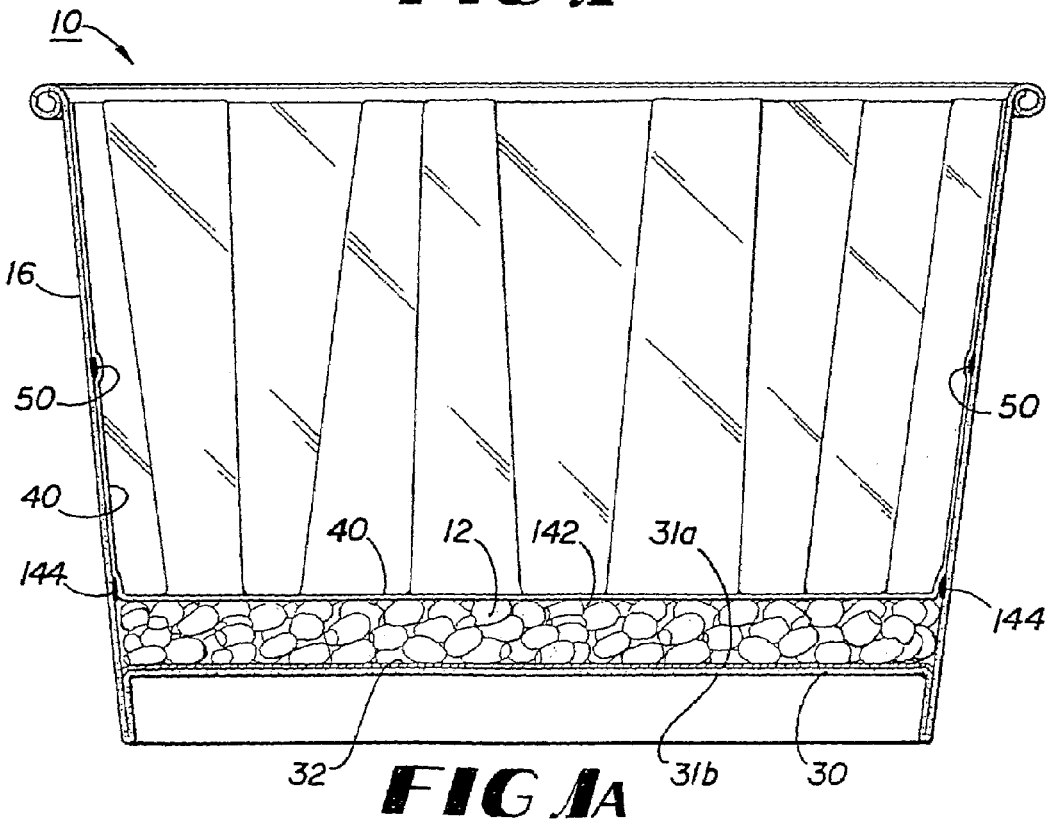
FIG. 1*a* shows a cross-sectional elevation of a container according to another embodiment of the present invention.

It will be appreciated that, however, as shown in FIG. 1*a*, the food product 12 can be contained in a volume 142 defined by the sheet of barrier material 40, the interior face 31*a* of the floor 30 and the wall panel(s) 16. In this embodiment, a seal 144 is provided between the sheet of barrier material 40 and the interior face of the wall panel(s) 16. The seal 144 can be a continuous seal formed by heat sealing to hermetically seal the food product 12 within the volume 142.

If the container 10 is of a type having a raised floor 30, the generally central disposition of the pocket 42 of food product 12 on the floor 30 also enhances nestability when a number of containers 10 are stacked, as the pocket 42 of a lower container will nest within the lower chamber 34 of an upper container. Moreover, if the container 10 is of a type having at least one projection or stacking ear 19 as shown in FIGS. 2 and 2*a*, the distance h is chosen such that when a number of containers 10 are stacked, an upper container is supported at a selected position by an adjacent lower container through the engagement of the flap portion 21 of the projection 19 with the upper edge(s) of the panel wall(s) 16 with the bottom of the upper container barely in contact with the pocket 42 of the lower container. This avoids the situation wherein the food product 12 in the pocket 42 of the lower container is severely depressed by the upper container (s), thereby allowing more containers 10 to be stacked together without a concern that the pocket(s) 42 of food product of the lower container(s) will be damaged.

Referring now back to FIG. 1, a first attachment 50 may be provided between the sheet of barrier material 40 and the interior surface of the wall panel(s) 16 approximately midway up the height of the wall panel(s) 16. Location of the first attachment 50 approximately midway up the height of the wall panel(s) prevents the sheet of barrier material 40 from rising a substantial distance above the mouth 20 of the container 10 upon inflation with steam or expanding air during heating. A second attachment 52 is preferably also provided between the sheet of barrier material 40 and the wall panel(s) 16 adjacent the mouth 20 of the container 10. The second attachment 52 prevents contamination of the interior, food-contacting surfaces of the container 10 during shipping and storage. The first attachment 50 can be continuous about the container 10, and will partially release upon heating to permit steam and expanding air to escape. The second attachment 52 can be discontinuous, in order to allow steam and expanding air to escape, and to facilitate removal of the barrier material 40 by the consumer. The first and second attachments 50 generally do not fully release upon heating, but are readily released manually by a consumer after cooking of the food product 12. Attachment of the sheet of barrier material 40 to the wall panel(s) 16 also prevents the sheet of barrier material 40 from interfering with the stacking of multiple containers in a nested array. Note that in the embodiment where the sheet of barrier material 40 only covers the floor 30, optional one or more attachments can be provided between the sheet of barrier material 40 and the interior face 30*c* of the peripheral outer portion 30*b* of the floor 30. Attachments can be formed in various kinds of means normally used in the art including glue, or heat sealing, etc.

As seen best with reference to FIGS. 2–5, the tub assembly 13 of the present invention may take the form of a generally polygonal (viewed from the top), hollow tub 60, having three or more wall panels 16*a*–16*d*. In one embodiment, the tub assembly 13 is generally rectangular, having four wall panels 16*a*–16*d*, and a floor 30, the floor 30 indicated by broken lines in FIGS. 2 and 4. The term "generally rectangular" and any similar terms used herein are intended to describe a three-dimensional prismoidal or inverted frusto-pyramidal shape with corners of approximate right angles between adjacent walls. The rectangular tub 60 can take any of a number of particular embodiments, several of which will be described herein by way of example, but not by way of limitation.

In a first example embodiment, described with reference to FIGS. 2, 2*a*, 3*a* and 3*b*, the wall panels 16*a*–16*d* are formed from a unitary paperboard sidewall blank 70, folded along score lines 72. One end of the blank 70 can be provided with a gluing tab 74 for attachment to the opposite end upon folding to form a generally rectangular four-sided sidewall assembly 14. Notches 76 can be formed along the base edge of the wall panels 16*a*–16*d* by removal of a cutout portion 78 of the wall panels 16*a*–16*d*. In this manner, legs 80 are formed at corners of the container defined by the intersection of adjacent wall panels 16*a*–16*d*. The notches 76 allow air circulation to and from the lower chamber 34 during heating, thereby preventing an excess buildup of heat. The size of the cutout portion 78 is variable. It should not be too large to affect the solidarity of the legs 80. Nor should it be too small to affect air circulation to and from the lower chamber 34. The floor 30 can be formed by folding a bottom panel blank 82. The floor blank 82 comprises a generally rectangular floor panel 84, and four edge panels 86*a*–86*d*. The edge panels 86*a*–86*d* are folded to form approximate right angles with the floor panel 84, and are attached to respective wall panels 16*a*–16*d*, as by adhesives or other standard attachment means, to provide a raised floor 30 supported a distance above a supporting surface such as the floor of a microwave oven. Although the corner webs 88 can be removed prior to folding the floor blank 82, it is desirable that they be retained and folded along the score lines indicated in FIG. 3*b*, so that the edge panels 86*a*–86*d* and corner webs 88 form a continuous, leak-proof wall extending substantially upright from the floor panel 84 when the floor 30 is installed and attached into the wall assembly 14. Although the floor 30 can be installed with the edge panels folded upwardly, forming a tray-like containment structure, the floor 30 can alternatively be installed and attached into the wall assembly 14 with the edge panels oriented downwardly. As described in greater detail above, the floor 30 comprises a moisture barrier, and further comprises a microwave susceptor, which, in a one embodiment, includes a sized metal layer to facilitate microwave heating.

Figure 5A:
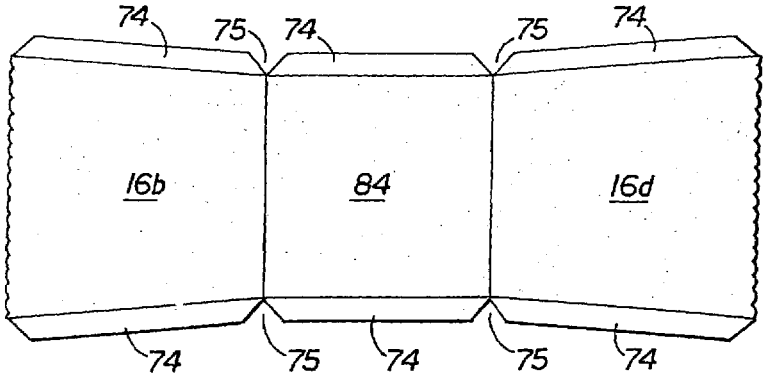
FIGS. 5*a* and 5*b* show top plan views of blanks used to fabricate the container of FIG. 4, according to another form of the invention.
Figure 5B:
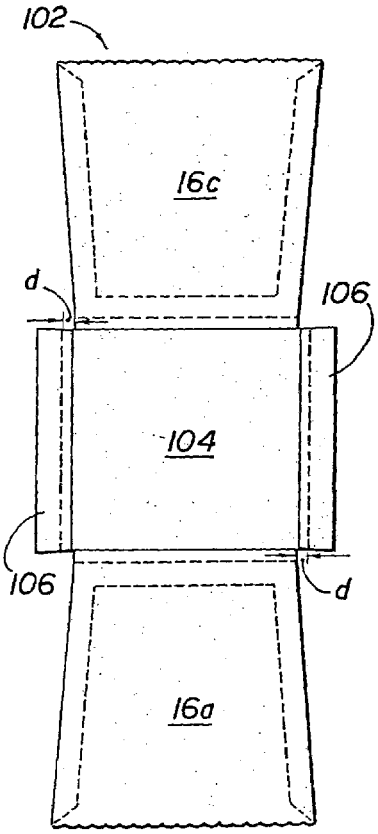

In another embodiment, described with reference to FIGS. 4, 5*a* and 5*b*, a generally rectangular tub 60 is formed from a first paperboard blank 100 and a second paperboard blank 102. The first blank 100 comprises second and fourth wall panels 16*b*, 16*d*, and a floor panel 84 therebetween The second blank 102 comprises first and third wall panels 16*a*, 16*c*, and a substantially continuous base panel 104 extending therebetween. The wall panels 16*a*–16*d* are folded upwardly from the floor and base panels 84, 104 to form a pair of container subassemblies. These subassemblies are arranged in a crosswise configuration, with the floor panel 84 overlying the base panel 104, and the wall panels 16*a*–16*d* forming a four sided sidewall assembly 14. Base extensions 106 of blank 102 are adhesively affixed to the lower portions of wall panels 16*b*, 16*d*, with the floor panel 84 raised a distance d above the base panel 104, thereby forming a lower chamber 34 bounded on its bottom by base panel 104, on its top by floor panel 84, on two sides by base extensions 106, and on two sides by wall panels 16*b*, 16*d*. Openings (not shown) can be provided at the corners formed by the intersections of the wall panels 16*b*, 16*d* and the base extensions 106, to permit air circulation to and from the lower chamber 34. Gluing tabs 74 are provided on wall panels 16*b*, 16*d* and on floor panel 84, and are affixed to wall panels 16*a*, 16*c* to complete assembly of the container 10. V-shaped notches 75 can be removed between the gluing tabs 74; or alternatively, the portion of the blank 100 between gluing tabs 74 can be left intact and folded, as shown in broken lines in FIG. 5*a*, to form a more liquid tight container. As described in greater detail above, the floor panel 84 comprises a moisture barrier, and preferably further comprises a microwave susceptor, which, in one embodiment, includes a sized metal layer to facilitate microwave heating.

Other embodiments may alternatively be devised. For example, multi-walled tub assemblies having three wall panels 16, or five or more wall panels 16, are possible. Additionally, each wall panel 16 may be formed from one or more separate paperboard blanks, and attached to one another to form the sidewall assembly 14 by adhesive, folding and crimping, or other attachment means. Also, although the blanks used to form the tub assembly have generally been referred to a paperboard blanks, other materials of fabrication are possible, such as for example, cardboard and card stock, paper, plastic sheeting, and other foldable, moldable or formable materials.

Method of Assembly

The present invention is further related to a method of assembling or making a container for microwave heating of a food product substantially as described above. The method of assembly will be described with particular reference to FIGS. 6 and 8.

Referring now to FIG. 6, a sheet of barrier material 40 is provided. A pocket 42 is formed in the sheet of barrier material 40 by folding, crimping, or plastically and/or elastically deforming the sheet of barrier material 40. The pocket can be formed by a vacuum platen 120, such as, for example, a mandrel. Alternatively, the pocket 42 can be formed by mechanical folding or deformation. The vacuum platen 120 includes a recess 122 corresponding to the desired shape and size of the pocket 42 to be formed. A vacuum source 124 is in communication with the recess 122 to suction form the pocket 42 in the sheet of barrier material 40. A male plug or mandrel (not shown) can be provided, cooperating with the recess 122 to form the pocket 42. The vacuum platen 120 can further comprise heating means 126 to apply heat to the sheet of barrier material 40 to assist in forming the pocket 42. Moreover, heat can be applied from an external source to assist in forming the pocket 42.

A quantity of food product 12 is deposited in the pocket 42 formed in the sheet of barrier material 40. The food product can be, for example, popcorn, pork rinds, puffed cheese snacks, or other food product. Cooking oil, shortening, spices, preservatives, flavorings, stabilizers, colorants, or other substances may be included with the food product. Metering means 128 are provided for metering a predetermined amount of the food product, as by weight, quantity or volume.

An inverted tub assembly 13 is placed over the food product 12. The tub assembly 13 can include, for example, a generally rectangular or cylindrical tub assembly having a floor 30 and at least one wall panel 16. The floor 30 of the tub assembly 13 has a moisture barrier, and also comprises a microwave susceptor, which, in one embodiment, includes a sized metal layer to facilitate microwave heating. The tub assembly 13 can be fabricated by folding at least one blank, as described above by way of particular examples, to form a floor and at least one wall panel. The tub assembly is placed over the food product, which is disposed in the pocket formed in the sheet of barrier material 40, in an upside-down orientation with the mouth 20 of the tub assembly generally downward. The barrier material surrounding the food product is brought into contact with the floor of the tub assembly, with the remainder of the barrier material draping downward along the interior of the walls of the tub assembly.

A seal 44 is formed between the sheet of barrier material 40 and the floor 30 of the tub assembly 13 to encapsulate the quantity of food product 12 between the sheet of barrier material 40 and the floor 30 of the tub assembly. The seal 44 is at least partially continuous around the pocket and formed by heat sealing the sheet of barrier material 40 to the floor of the tub assembly. For example, a heating element can be brought into contact with the exterior face of the floor panel 30 to form the heat seal.

According to the method of the present invention, the food product is hermetically sealed within the container by depositing the food product 12 between the sheet of barrier material 40 and a moisture barrier portion of the container, such as the floor 30 of the container, and forming a continuous seal between the barrier material and the moisture barrier portion of the container, as described above.

The sheet of barrier material 40 can optionally be attached to one or more wall panel(s) of the tub assembly. For example a first attachment 50 can be made between the sheet of barrier material 40 and the wall panel(s) approximately mid-height along the wall panel(s), and/or a second attachment 52 can be made between the sheet of barrier material 40 and the wall panel(s) adjacent the mouth of the tub assembly.

Referring now to FIGS. 8 (A–E) and 9, in one embodiment of the present invention, a mandrel 802 is provided. The mandrel 802 has a body portion 804 and a top portion 806. The top portion 806 of the mandrel defines a recess 808 corresponding to the desired shape and size of a pocket 842 to be formed. An exterior surface 807 of the mandrel also defines a plurality of bores 805 in at least a portion of the top portion and a portion of the body portion. A sheet of barrier material 810 is provided and then draped over the top portion and at least a portion of portion. The sheet is held to a portion of the mandrel 802 by suction applied from a vacuum source 809 in communication with the bores 805 in the mandrel. The suction holds the sheet 810 in place so as to form a pocket 842 within the recess 808. The pocket 842 can then be filled with food product 812. As noted above, the food product can be, for example, popcorn, pork rinds, puffed cheese snacks, or other food product. Cooking oil, shortening, spices, preservatives, flavorings, stabilizers, colorants, or other substances may be included with the food product. Metering means 828 are provided for metering a predetermined amount of the food product, as by weight, quantity or volume.

Figures 8A, 8B, 8C, 8D, 8E, 9:
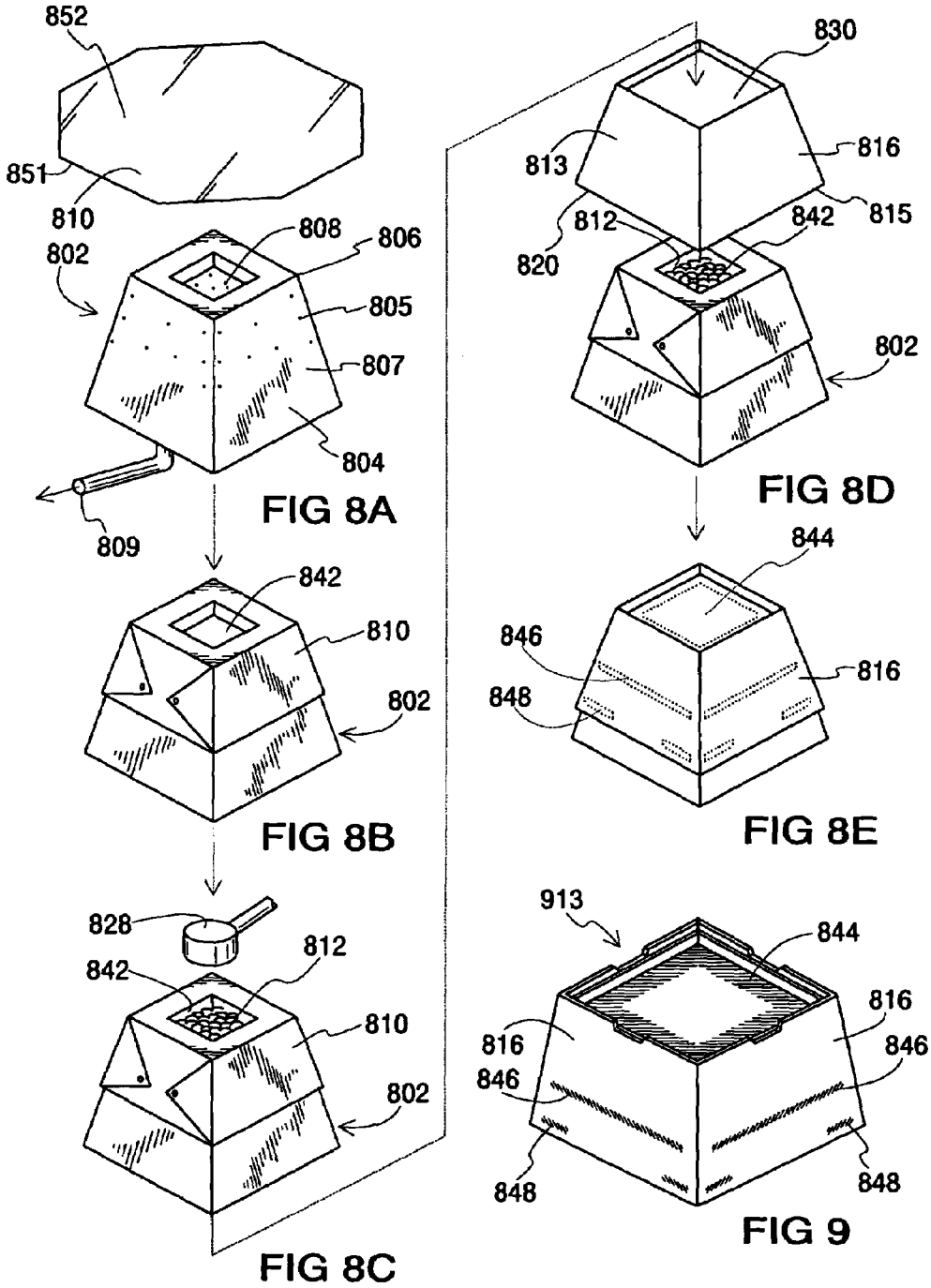
FIG. 9 shows a perspective view of a container according to one embodiment of the present invention.

A pre-erected tub assembly 813 is placed over the pocket 842 filled with the food product 812. The tub assembly 813 can be a container in various forms such as a rectangular, a cylinder, a frusto-cone and the like. As shown in FIG. 8D, the tub assembly 813 has a floor 830, at least one wall panel 816, an interior surface 815, and a mouth 820 that is opposite to the floor 830 and communicates to the ambient air. The tub assembly 813 is placed over the pocket 842 in an upside-down orientation with the mouth 820 downwardly to the mandrel 802.

A seal 844 may be formed between the film 810 and the interior surface. 818 of the tub assembly 813 to encapsulate the food product 812 in the pocket 842 so as to form a food container 913 as shown in FIG. 9. In one embodiment, the seal 844 is formed between the film 810 and the floor 830 of the tub assembly. In this embodiment, the seal 844 can be formed around the pocket 842 such that at least a partial peripheral outer portion is formed to separate the food product 812 from the at least one wall panel 816. Additional seals 846 and 848 can also be formed. Seal(s) 846 can be made between the film 810 and the at least one wall panel 816 approximately mid-height. Seal(s) 848 can be made between the film 810 and the at least one wall panel 816 adjacent the mouth 820. In one operation, seals 844, 846 and 848 may be formed by heat sealing in a sequence as seal(s) 844 is formed first, seal(s) 846 is formed second, and seal(s) 848 is formed the last.

Thus, in one embodiment, the present invention provides a method of making a container for microwave heating of a food product. The method includes providing a mandrel 802 having an exterior surface 807, a body portion 804, and a top portion 806, the top portion of the mandrel defining a recess 808 and the exterior surface of the mandrel defining a plurality of bores 807 in at least a portion of the top portion and at least a portion of the body portion and providing a sheet of barrier material having a first side and a second side. In operation, the first side 851 of the sheet is draped on the mandrel over the top portion and at least a portion of the body portion thereof and a vacuum is applied to the bores of the mandrel to hold at least a portion of the sheet about a portion of the mandrel and to define a pocket 842 in a portion of the at least a portion of the sheet 810 being held within the recess 808 of the mandrel. A quantity of the food product 812 is deposited within the pocket and a pre-erected tub assembly 813 is positioned in overlying orientation with the mandrel and the quantity of food product such that the pocket is substantially closed by the interior face of the floor. Finally, a portion second side of the barrier material is sealed to the interior surface 815 of the tub assembly about the pocket to encapsulate the quantity of food product between the barrier material and the interior face of the floor of the tub assembly.

The method of making a container for microwave heating of a food product of the present invention can be practiced using automation, which will be discussed in more detail in next section.

Apparatus of Making a Container of the Present Invention

Figure 10:
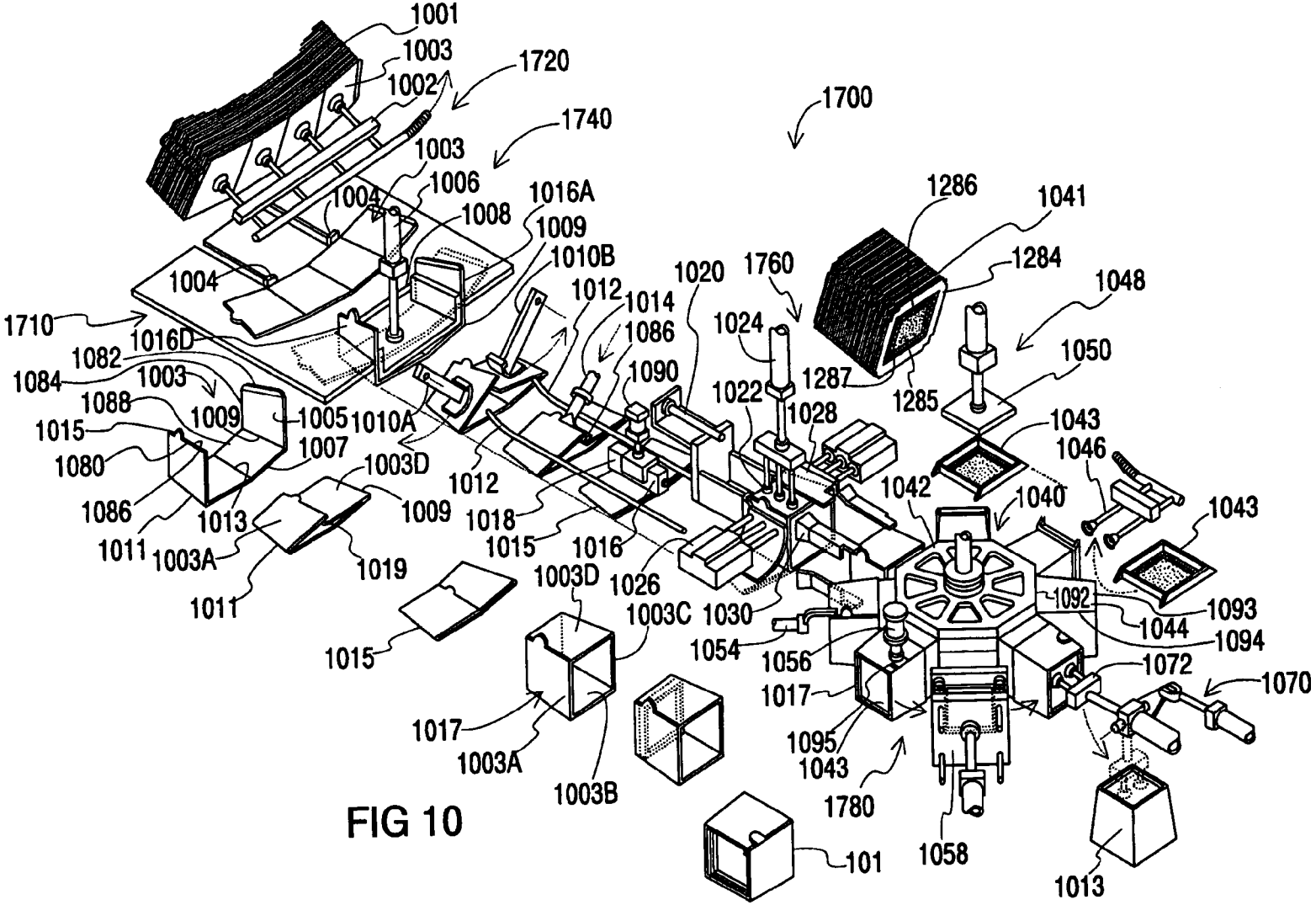
FIG. 10 shows a partial view of the apparatus for making a container as shown in FIG. 9 according to one embodiment of the present invention, wherein in particular a container fabrication subassembly is partially shown.
Figure 11:
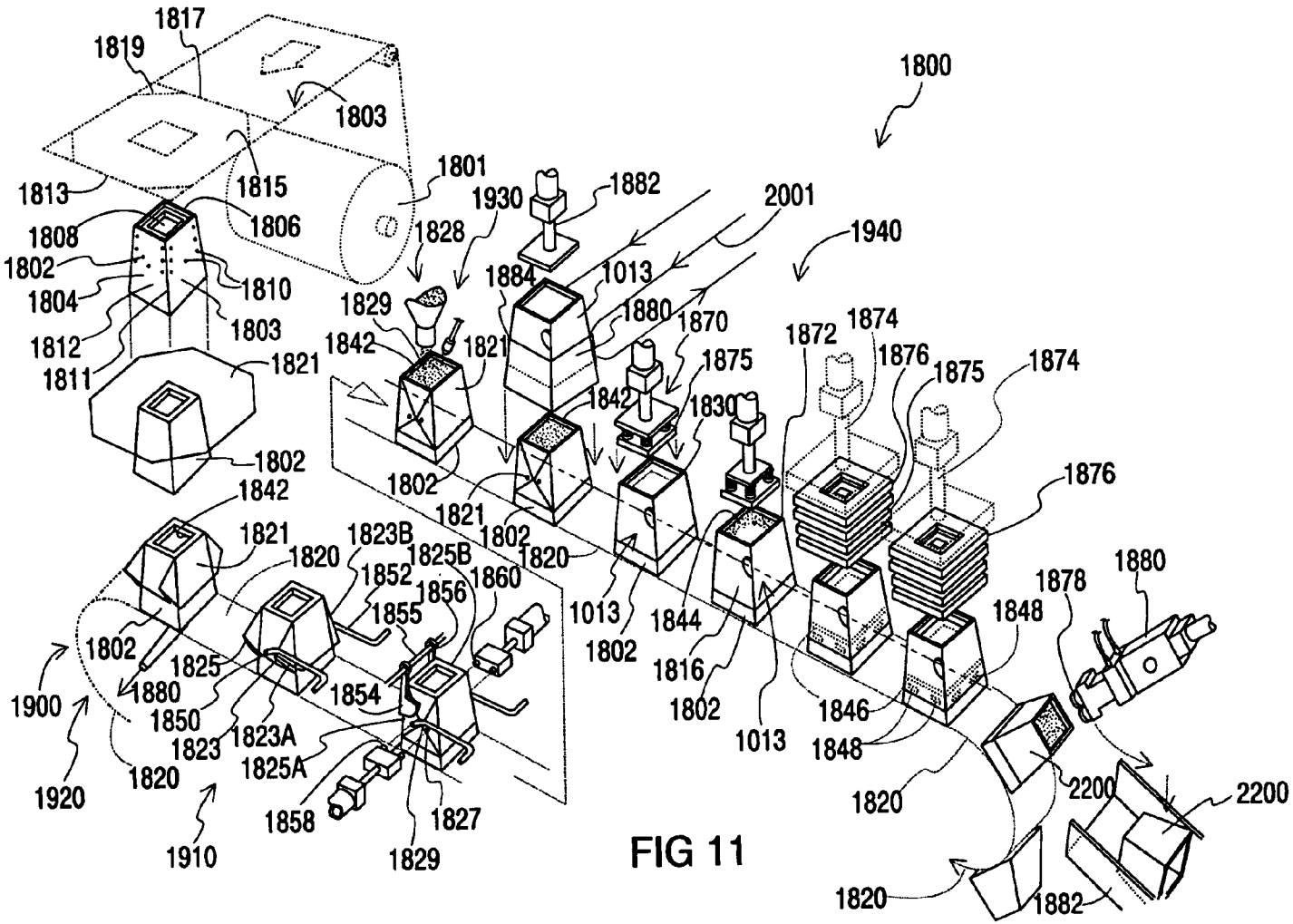
FIG. 11 shows a partial view of the apparatus for making a container as shown in FIG. 9 according to one embodiment of the present invention, wherein in particular a combined subassembly for film liner fabrication, food filing and integration is partially shown.

Referring now to FIGS. 10 and 11, as one will appreciate, the pre-erected tub assemblies 1013, such as the various tub assembly embodiments described above, may be fabricated using conventional container forming apparatus and methods. Referring now to FIG. 10, an exemplary tub assembly fabrication subassembly 1700 is shown. The tub assembly fabrication subassembly 1700 has a blank infeed station 1720 mounted on a second frame structure 1710 for receiving a wall panel blank 1003. The wall panel blank 1003 has a first side 1005, an opposite, second side 1007, a first edge surface 1080, an opposed second edge surface 1082, and a bottom edge 1084 extending between the first edge surface and the second edge surface. The wall panels 1016 are hingedly connected along separate score lines 1009, 1011, and 1013. At least a portion of the first edge surface of each wall panel blank has a heat sensitive adhesive 1086 disposed on at least a portion thereof. Similarly, at least a portion of the wall panel blank proximate the bottom edge of the wall panel blank may have a heat sensitive adhesive 1088 disposed thereon.

The blank infeed station 1720 may include a blank stripper 1002 constructed and arranged to deliver one wall panel blank 1003 from a supply of wall panel blanks 1001 to an indexing conveyor 1004 that conveys the wall panel blank to a blank receiving station. The blank receiving station 1740 in mounted on the second frame structure and constructed and arranged for receiving the wall panel blank from the blank infeed station. A portion of the blank receiving station defines a frame opening 1008 extending beneath and substantially co-planer to the plane defined by the blank moving along a first transfer path in the blank receiving station. The blank receiving station also includes a plunge ram 1006 being positioned above the lank receiving station for movement along a generally linear plunge stroke path between a raised position and a lowered position. The plunge stroke path is generally perpendicular to and extending through the plane of the blank. In use, the plunge ram 1066 passes through the frame opening to fold the wall panel blank 1003 along score lines 1009, 1011 to form a first wall panel 1016D, having the first edge surface, and a second wall panel 1016A, having the second edge surface.

A first pivot arm 1010A and a second pivot arm 1010B are provided. Each pivot arm is constructed and arranged on the second frame member for pivotal movement between a raised position and an engaged position, in which a portion of the first pivot arm contacts a portion of the first wall panel and a portion of the second pivot arm contacts a portion of the second wall panel so that the first edge surface of the wall panel blank is positioned in at least partial overlapping registration with the second edge surface. Once the first and second wall panels are folded into overlapping registration, guide bars 1012 direct the folded wall panel blank to a means for heating the adhesive 1086 disposed on the first edge surface to connect at least a portion of the first edge surface and a portion of the second edge surface to form a blank structure. In one example, the first and second wall panels 1016D, 1016A pass through a heating device such as heat manifold 1014. The heat manifold 1014 is in communication with a heat supply such as a supply of hot air and activates the heat sensitive adhesive by hot air. A pressure device such as a pressure foot 1090 may apply pressure to the edges of the wall panels 1016D, 1016A and a chill plate 1018 may cure the adhesive along the first and second edge surfaces to form the blank structure 1015.

The blank structure 1015 is then transferred to an erection station 1760. The erection station 1760 has a suction ram having a means for selectively grasping a portion of the blank structure. The suction ram 1024 is constructed and arranged on the second frame structure for movement along both a generally linear and planar suction ram stroke path between a lowered position, in which an end 1022 of the suction ram selectively grasps a portion of one wall panel of the blank structure 1015, and a raised position, in which the end of the suction ram grasping the portion of the one wall panel is withdrawn along the suction ram stoke path to form a sidewall structure 1017 in which the adjoining respective wall panels are at approximate right angles with respect to each other. The grasping means may include a plurality of suction cups 1022 that are in communication with a vacuum source (not shown) through the suction ram 1024. The erection station 1760 further may include a pair of opposing sidewall squaring plates 1026, 1028 constructed and arranged to engage opposing wall panels of the wall structure as the suction ram is raised. The squaring plates may cooperate with the plurality of suction cups 1022 to erect the blank structure 1015 into the sidewall structure 1017 having sidewalls 1016A, 1016B, 1016C and 1016D. The erection station also has a plow transfer member 1020 being positioned above the transfer path for generally linear movement along a plow stroke path. The plow transfer member transfers the formed sidewall structure onto a portion of a fabrication station 1780.

The fabrication station has a turntable 1042 that is rotatable about an axis substantially perpendicular to the transfer path defined, at this station, by the plow stroke path. The turntable has a plurality of turntable mandrels 1044 being positioned about a peripherial edge of the turntable. Each turntable mandrel has a base 1092, an opposed end 1093, which is sized and shaped for complementary receipt of one bottom structure, and a body portion sized 1094 and shaped for complementary receipt of one sidewall structure 1017. The fabrication station has a means for positioning a bottom structure 1043 on the end of the turntable mandrel so that the edge panels of the bottom structure extend toward the base of the turntable mandrel. In operation, as the turntable rotates, one turntable mandrel having one bottom structure positioned thereon is positioned with respect to the plow stroke path of the erection station so that one sidewall structure is pushed onto the mandrel and over the bottom structure 1043 as the plow transfer member extends along the plow stroke path. This results in at least a portion of the sidewall structure proximate the bottom edge of the wall panel blank being placed in contact with a portion of the edge panels of the bottom structure.

In a separate line of operation, a supply of bottom panel blanks 1041 is provided. Each bottom panel blank has a base 1285 and a plurality of edge panels being 1286 hingedly connected to the base of the bottom panel blank along scored fold lines 1287. A foot plunger 1048 having a foot 1050 sized and shaped for complementary receipt with the base of the bottom panel blank is constructed a arranged for movement along a generally linear path from a raised position to a lowered position. In the lowered position, the foot of the foot plunger cooperates with one bottom panel blank 1041, which is provided from the supply of bottom panel blanks, so that the edge panels of the bottom panel blank are folded about the scored fold lines therein to form a bottom structure 1043. In one embodiment, a pair of suction arms 1046 picks up the formed bottom structure 1043 and positions it on one of the turntable mandrels 1044. Each turntable mandrel 1044 may be in communication with a vacuum source (not shown) and is constructed and arranged to hold the formed bottom structure 1043 onto the end 1093 of the turntable mandrel. As formed, the bottom structure 1043 is complementally sized to fit within a portion of the sidewall structure 1017.

The fabrication station may include a squaring horn 1030 that cooperates with the plow transfer member 1020. The squaring horn is constructed and arranged to position the sidewall structure 1017 over a formed bottom structure 1043 that is on one of the turntable mandrels 1044. The sidewall structure 1017, now positioned with respect to the formed bottom structure, then moves with the mandrel 1044 to a heating device such as heat manifold 1054. The heat manifold 1054 is in communication with a heat supply such as a supply of hot air and activates adhesive associated with the tap 1095 by hot air. A pressure device such as pressure foot 1056 applies pressure to the tap 1095 to seal it to the sidewall of the structure 1017. In the next position, a means for applying heat to the adhesive 1088 disposed on the bottom edge of the panel blank is provided to connect at least a portion of the wall panels to at least a portion of the edge panels to form one tub assembly. As noted above, the heating means may be, for example, a heating device such as a heater assembly 1058, which is in communication with a heat supply such as a supply of hot air. The heat assembly may activate the adhesive strips along the corresponding edges of the sidewall structure 1017 and the formed bottom structure 1043 to seal the formed bottom structure 1043 and the sidewall structure 1017 together to form a finished tub assembly 1013. An extractor 1070 uses its suction cup assembly 1072 to remove the finished tub assembly 1013 from the mandrel 1044 and positions the finished tub assembly 1013 inverted for further operation. In the meantime, the mandrel 1044 rotates with the turntable 1042 and is ready to receive another formed bottom structure 1043.

Referring now to FIG. 11, a container integration subassembly 1800 on a frame structure 1900 is shown in communication with a supply of pre-erected tub assemblies 1013, such as fabricated in the exemplified tub assembly fabrication subassembly discussed above. Here, the pre-erected tub assemblies 1013 are in communication with the container integration subassembly via a first transfer mechanism 2001 such as, for example, a conveyor, constructed and arranged for conveying the tub assemblies to a container erection station 1940 of the container integration subassembly.

In one embodiment, a film feed conveyor 1803 provides a sheet of a barrier material 1821 from a supply of barrier material such as, for example, a film roll 1801. The sheet of barrier material 1821 has a first side 1813 and an opposite, second side 1815. Cutting means such as heat wires (not shown) separates one sheet 1821 from the barrier material supply along a selected line 1817. Additionally, cutting means may trim corners of the sheet 1821.

Furthermore, the container integration subassembly may include a transfer station 1910 carried on the frame structure. The transfer station includes a first plurality of mandrels 1802 and a means for conveying the mandrels along a generally linear transfer path, such as, for example, a conveyor 1820. Each mandrel 1802 has an exterior surface 1803, a body portion 1804, a top portion 1806. The top portion 1806 defines a recess 1808 corresponding to the desired shape and size of a pocket to be formed to contain a desired amount of food product. Further, the exterior surface of the mandrel 1802 defines a plurality of bores 1810 distributed over the body portion 1804, top portion 1806, and within the recess 1808 of the mandrel.

The mandrels are conveyed to a sheet receiving station 1920 that is in fluid communication with a vacuum source 1880 The sheet receiving station is constructed and arranged for receiving, positioning and holding a portion of the first side of the sheet on the exterior surface of the mandrel. The sheet of barrier material 1821 is draped on the top portion and about at least a portion of the body portion of the mandrel and the barrier material 1821 is attracted to and held against the exterior surface the mandrel 1802 by suction applied by the vacuum source through the bores 1810. The applied suction holds the barrier material 1821 in place to define a pocket 1842 in a portion of the sheet that is being held within the recess 1808 of the mandrel.

In one embodiment, the exterior surface 1803 of the mandrel defines a plurality of corners 1811 and a plurality of sides 1812 extending therebetween. As one will appreciate, a plurality of extending flaps in the sheet are defined as portions of the sheet are held against the exterior surface of the mandrel and, generally, one such flap is defined adjacent each corner of the mandrel. Each such flap is formed from overlapping portions of the first side of the sheet.

The sheet receiving station may include a first static arm member 1850 and a second static arm member 1852. The first static arm member being positioned along a first side of the linear transfer path of the conveying means and the second static arm member being positioned along a second side of the linear transfer path of the conveying means. In operation, the first and second static arms 1850, 1852 fold leading flaps 1823A, 1823B upon the advance of the mandrel 1802 with the motion of the conveyor 1820. Thus, a portion of the first static arm member engages a portion of one of the flaps 1823A and pushes the flap into contact with a portion of the second side of the sheet as the mandrel moves along the transfer path and a portion of the second static arm member engages a portion of a second one of the flaps 1823B and pushes the flap into contact with a portion of the second side of the sheet as the mandrel moves along the transfer path. As shown, the first and second flaps 1823A, 1823B are preferably positioned on opposite sides of the mandrel.

The sheet receiving station may also include a plow member 1855 having a pair of opposing planer plow elements 1854, 1856. In operation, the plow elements fold trailing flaps 1825A, 1825B toward the body portion of the mandrel 1802. The plow elements being positioned above the mandrels for pivotal movement between a raised position and a contact position. In the contact position, each respective plow element engages and fold one of a third one of the flaps 1825A or a fourth one of the flaps 1825B, respectively, into contact with a portion of the second side of the sheet. Preferably, the first flap 1823A and the third flap 1825A are on the same side of the mandrel and the second flap 1823B and the fourth flap 1825B are positioned on the opposite side of the mandrel.

The sheet receiving station may also include a pair of heat elements 1858, 1860 for heat welding flaps 1823, 1825 at each side at corresponding spots 1827, 1829 on the second side of the barrier material. Each heat element is positioned along one of the respective first and second sides of the linear transfer path for movement along a linear heat element stroke path between a non-engaged position and an engaged position in which the heat element contacts and heat welds a portion of the respective flaps to the respective portions of the second side of the sheet. Each heat element 1858 is, for example, a conventional heat gun.

The mandrel 1802 then moves along the transfer path to a food product station 1930 having a conventional means for depositing and metering a predetermined quantity of food product 1829 within the pocket 1842. The depositing means is positioned proximate the pocket to minimize waste. After filing the pocket to the desired level, the mandrel 1802 moves to the container erection station 1940, which, as described above, is in communication with a supply of pre-erected tub assemblies 1013 via the first transfer mechanism 2001.

The container erection station is positioned with respect to the mandrels and has a means for positioning the mouth of one of the tub assemblies in overlying orientation with one of the mandrels and the quantity of food product such that the pocket is substantially closed by the interior face of the floor of the tub assembly. The positioning means may include a frame 1880 that cooperates with an assembly transfer member 1882. The frame defines an opening 1884 in communication with the first transfer mechanism. As one will appreciate, as the assembly transfer member extends, it contacts a portion of the floor of the tub assembly 1013 and pushes the mouth of the tub assembly over the mandrel and the quantity of food product deposited within the pocket such that the pocket is substantially closed by the interior face of the floor of the tub assembly. Thus, in operation, a pre-erected tub assembly 1013 is placed over the pocket 1842 filled with the food product 1829. The tub assembly 1013 is placed over the pocket 1842 in an upside-down orientation with its mouth 1820 moving downwardly to the mandrel 1802.

In an alternative embodiment, the transfer member may have a suction means at a distal end of the transfer member for selectively grasping a portion of the floor of the tub assembly. The suction means may include at least one suction cup in communication with a vacuum source. In use, the suction cup selectively grasps the portion of the floor of the tub assembly and then places the tub assembly, as the transfer member extends, in the desired overlying registration with the pocket and the mandrel. In a further alternative embodiment, the extractor 1070, as shown in FIG. 10, may position the tub assembly over the pocket 1842 filled with the food product 1829.

The container integration subassembly 1800 also includes a means for sealing the second side of the barrier material to the interior surface of the tub assembly about the pocket to encapsulate the quantity of food product between the barrier material and the interior face of the floor of the tub assembly. In one embodiment, the second side 1815 of the barrier material 1821 is heat sealed to the interior face of the floor of the tub assembly so that a least a partial peripheral outer portion is formed to separate the food product from the at least one wall panel. In this embodiment, each of the first plurality of mandrels 1802 has a longitudinal axis, and the sealing means includes a heated ram 1870 positioned above the mandrels for movement along a generally linear ram stroke path that is generally co-axial with the longitudinal axis of the mandrel, between a raised position and a lowered position. In the lowered position, a portion of the heated ram is placed in contact with a portion of the exterior face of the floor of the tub assembly so that the pocket is substantially closed by the interior face of the floor. The heated ram has a heating element 1873 such as, for example, a hot plate, constructed and arranged for heat sealing the barrier material to the interior floor of the tub assembly to encapsulate the food product 1829 in the pocket 1842. As noted above, in one embodiment, the seal 1844 is formed around the pocket 1842 such that at least a partial peripheral outer portion is formed to separate the food product 1829 from the at least one wall panel 1816. But, as one will appreciate, in an alternative embodiment, the seal 1844 may be formed around the pocket 1842 such that the food product 1812 is not separated from the at least one wall panel 1816.

The sealing means may include a sleeve member 1874 being positioned above the mandrels for movement along a generally linear sleeve stroke path between a raised position and a lowered position. As one will appreciate, the sleeve stroke path is generally co-axial with the longitudinal axis of the mandrel. The sleeve member 1874 may include at least one heating element 1875, such as, for example, hot plates 1876 with openings defined therein. As one will appreciate, each heating element is sized to engage portions of the at least one wall panel of the tub assembly 1013 in the lowered position to further seal the tub assembly and the barrier material 1821 together to form a finished food product container 2200. The heating element of the sleeve member attaching the barrier material to the at least one wall panel of the tub assembly at an attachment. In alternative embodiments, two or more attachments 1846, 1848 may be formed between the barrier material and the one embodiment, such as, for example at approximately mid-height along the tub assembly and adjacent the mouth of the tub assembly. A cold plate 1872 may be provided to engage the heated annual edge of the floor of the tub assembly 1013 so as to cure the seal 1844.

Finally, the container integration station may include a rotatable extractor 1880. In one embodiment, the rotatable extractor has a plurality of suction cups 1878 that draw the finished food product container 2200 away from the mandrel 1802 and deliver it to a discharge chute 1882, which can then transfer the finished food product container 2200 for further operations such as quality control and assurance, sampling and packing.

Although the illustrative embodiments of the present disclosure have been described herein with reference to the accompanying drawings, it is to be understood that the disclosure is not limited to those precise embodiment, and the various other changes and modifications may be affected therein by one skilled in the art without departing from the scope of spirt of the disclosure. All such changes and modifications are intended to be included within the scope of the disclosure as defined by the appended claims.

What is claimed is:

1. A container for microwave heating of a food product, comprising:

a blank having an upper face and a lower face and two or more panels, wherein at least one of the panels is capable of being folded relative to the other panels; and a sheet of barrier material forming a pocket for containing a food product, the sheet of barrier material having an interior surface and an exterior surface, the interior surface of the barrier material being sealed to the upper face of the blank on one of the panels around the pocket so that a peripheral outer portion is formed to separate the food product from the at least one of the panels.

2. The container of claim 1, further comprising a microwave susceptor.

3. The container of claim 2, wherein the microwave susceptor is selected from the group consisting of a metallized film, a metal-based dispersion, a conductive coating and any suitable combination of the foregoing.

4. The container of claim 2, wherein the microwave susceptor is applied to either the lower face or upper face of the blank.

5. The container of claim 2, wherein the microwave susceptor substantially covers the blank underneath the pocket.

6. The container of claim 1, wherein the blank is moisture-impervious.

7. The container of claim 1, wherein the blank comprises a polymer and paperboard laminate.

8. The container of claim 1, wherein the sheet of barrier material is moisture-impervious.

9. The container of claim 1, wherein the sheet of barrier material comprises a polyester film.

10. The container of claim 1, wherein the pocket is formed in the sheet of moisture-impervious barrier material using a vacuum platen.

11. The container of claim 1, wherein the sheet of barrier material is continuously sealed to the upper face of the blank around the pocket by heat sealing.

12. The container of claim 1, wherein the blank further comprises a generally rectangular floor panel and four wall panels, the wall panels being folded upwardly to form approximate right angles with the floor panel.

13. The container of claim 1, further comprising a food product.

14. The container of claim 1, wherein said blank further comprises a moisture barrier.

15. A container for microwave heating of a food product, comprising:

a blank having an upper face and a lower face, the blank comprising a floor panel and one or more edge panels, the edge panels capable of being folded upwardly relative to the floor panel; and a sheet of barrier material forming a pocket for containing the food product, the sheet of barrier material having an interior surface and an exterior surface, the interior surface of the barrier material being sealed to the upper face of the floor panel around the pocket so that a peripheral outer portion is formed to separate the product from the at least one edge panel.

16. The container of claim 15, further comprising a microwave susceptor.

17. The container of claim 16, wherein the microwave susceptor is selected from the group consisting of a metallized film, a metal-based dispersion, a conductive coating and any suitable combination of the foregoing.

18. The container of claim 16, wherein the microwave susceptor is applied to the upper face or lower face of the blank.

19. The container of claim 16, wherein the microwave susceptor substantially covers the blank underneath the pocket.

20. The container of claim 15, wherein the blank is moisture-impervious.

21. The container of claim 15, wherein the blank comprises a polymer and paperboard laminate.

22. The container of claim 15, wherein the sheet of barrier material is moisture-impervious.

23. The container of claim 15, wherein the sheet of barrier material comprises a polyester film.

24. The container of claim 15, wherein the pocket is formed in the sheet of moisture-impervious barrier material using a vacuum platen.

25. The container of claim 15, wherein the sheet of barrier material is continuously sealed to the upper face of the floor panel around the pocket by heat sealing.

26. The container of claim 15, wherein the blank further comprises a generally rectangular floor panel and four wall panels, the wall panels being folded upwardly to form approximate right angles with the floor panel.

27. The container of claim 15, further comprising a food product.

28. The container of claim 15, wherein said blank further comprises a moisture barrier.

29. A container for microwave heating of food, comprising:

a blank having an upper face and a lower face, the blank comprising a floor panel and one or more edge panels, the edge panels capable of being folded upwardly relative to the floor panel;

a sheet of barrier material forming a pocket for containing a food product, the sheet of barrier material having an interior surface and an exterior surface, the interior surface of the barrier material being sealed to the upper face of the floor panel around the pocket so that a peripheral outer portion is formed to separate the product from the at least one edge panel; and the food product located in the pocket.

* * * * *